US012297008B2

(12) United States Patent
Sutton

(10) Patent No.: US 12,297,008 B2
(45) Date of Patent: May 13, 2025

(54) MODULAR RAIL-BASED STORAGE SYSTEM

(71) Applicant: Jeanne Sutton, Prairieville, LA (US)

(72) Inventor: Jeanne Sutton, Prairieville, LA (US)

( * ) Notice: Subject to any disclaimer, the term of this patent is extended or adjusted under 35 U.S.C. 154(b) by 0 days.

(21) Appl. No.: 17/866,593

(22) Filed: Jul. 18, 2022

(65) Prior Publication Data

US 2023/0020398 A1 Jan. 19, 2023

Related U.S. Application Data

(60) Provisional application No. 63/297,234, filed on Jan. 7, 2022, provisional application No. 63/223,008, filed on Jul. 18, 2021.

(51) Int. Cl.
*B65D 21/08* (2006.01)
*B65D 21/02* (2006.01)
*B65D 25/20* (2006.01)

(52) U.S. Cl.
CPC ..... *B65D 21/083* (2013.01); *B65D 25/20* (2013.01)

(58) Field of Classification Search
CPC .. B65D 21/083; B65D 21/00; B65D 21/0204; B65D 21/0202; B65D 21/0212; B65D 21/0216; B65D 21/20; B65D 21/22
USPC ..... 248/213
See application file for complete search history.

(56) References Cited

U.S. PATENT DOCUMENTS 1,030,801 A * 6/1912 Berault ..... E05D 7/1016 16/262
2,658,233 A * 11/1953 Kimmel ..... E05D 1/06 16/269
2,848,765 A * 8/1958 Showalter ..... E04F 10/08 248/291.1
3,141,684 A * 7/1964 Haber ..... B42D 5/022 462/17
3,188,686 A * 6/1965 Orcutt ..... E05D 5/128 16/263
5,381,844 A * 1/1995 Struben ..... E04H 15/08 52/592.1
5,645,254 A * 7/1997 Ng ..... B44C 5/00 248/205.5
7,011,273 B1 * 3/2006 Stanford ..... B60N 3/102 244/1 R
7,555,816 B2 * 7/2009 Walker ..... B60P 3/14 16/269
9,068,382 B1 * 6/2015 Hall ..... E05D 5/12
10,843,541 B2 * 11/2020 Schreiber ..... B60J 7/0573

* cited by examiner

*Primary Examiner* — Nkeisha Smith
(74) *Attorney, Agent, or Firm* — nolaIP, LLC; Neil Coig

(57) ABSTRACT

An improved apparatus for storing a wide assortment of articles in the form of a modular rail system and corresponding attachments which can be quickly attached and detached from said modular rail system, as well as remaining secure when attached.

23 Claims, 12 Drawing Sheets

11a

11b

MODULAR RAIL-BASED STORAGE SYSTEM

This application is a continuation of, and claims priority to, U.S. Provisional Patent Application 63/297,234, filed on 7 Jan. 2022, and is continuation of, and claims priority to, U.S. Provisional Patent Application 63/223,008, filed on 18 Jul. 2021, both of which are hereby incorporated by reference in their entirety.

BACKGROUND OF THE INVENTION

The present invention relates to a design for a modular system for gear, tools, tackle and other items.

Storage systems are as useful as they are old. For ages, the ability to consolidate, carry and organize items has served a critical part of our day-to-day lives. From toolboxes to backpacks, storage systems are ubiquitous, and coupling storage with organization is a tremendous advantage.

While the concept of storage is very well known, oftentimes there are limitations in the utility and versatility as currently employed in the known art. Many, if not all, storage products are limited in use and scope as defined by their design. Specialized storage products are often only useful for one type of product, limiting their utility, or have pre-defined sizes which restrict use. This leads to added expense in the form of specialized products required for individual types of products (which are generally more expensive), as well as added expense in a user having to utilize multiple products to store many types of gear. The below invention seeks to address these concerns and more.

The consequence of these issues is the inherent ineffectiveness of the current state of the art for gear transport. A solution which provides a simple way to effectively provide an adaptable, modular storage system has yet to be developed. All of the above aspects of the current state of gear storage lead to an increased need for a revised method of implementation with minimized cost and complexity, all of which the present invention addresses.

The disclosed invention provides a simple, innovative and effective apparatus for avoiding these problems. The proposed invention of a modular storage system is thus a novel, needed and functional answer to the problems in the field relating to storage systems and their use.

In the present invention, a storage system is built with a modular rail system designed to permit various attachments to be affixed thereto, ensuring that the storage system is never obsolete. This combination of features leads to independent, adaptable, customizable gear storage contained within an innovative system unlike any other available in the present state of the art.

OBJECTS OF THE INVENTION

One object of the invention is to provide a new modular rail-based storage system.

An additional object of this invention is to provide a new modular rail-based storage system with corresponding attachments.

Another object of this invention is to provide a new modular rail-based storage system that can accommodate a highly varied type of gear.

Yet another object of this invention is to provide a new modular rail-based storage system that can accommodate a large amount of gear.

Still another object of this invention is to provide a new modular rail-based storage system that is easy to attach and detach attachments thereto.

Still another object of this invention is to provide a new modular rail-based storage system that securely retains attachments.

Other objects and advantages of this invention shall become apparent from the ensuing descriptions of the invention.

SUMMARY OF THE INVENTION

An improved apparatus for storing a wide assortment of articles in the form of a modular rail system and corresponding attachments which can be quickly attached and detached from said modular rail system, as well as remaining secure when attached.

BRIEF DESCRIPTION OF THE DRAWINGS

The accompanying drawings and figures illustrate embodiment(s) of this invention. However, it is to be understood that these embodiments are intended to be neither exhaustive, nor limiting of the invention. They are but examples of some of the forms in which the invention may be practiced.

DETAILED DESCRIPTION OF EXEMPLARY EMBODIMENTS

Figure 1:
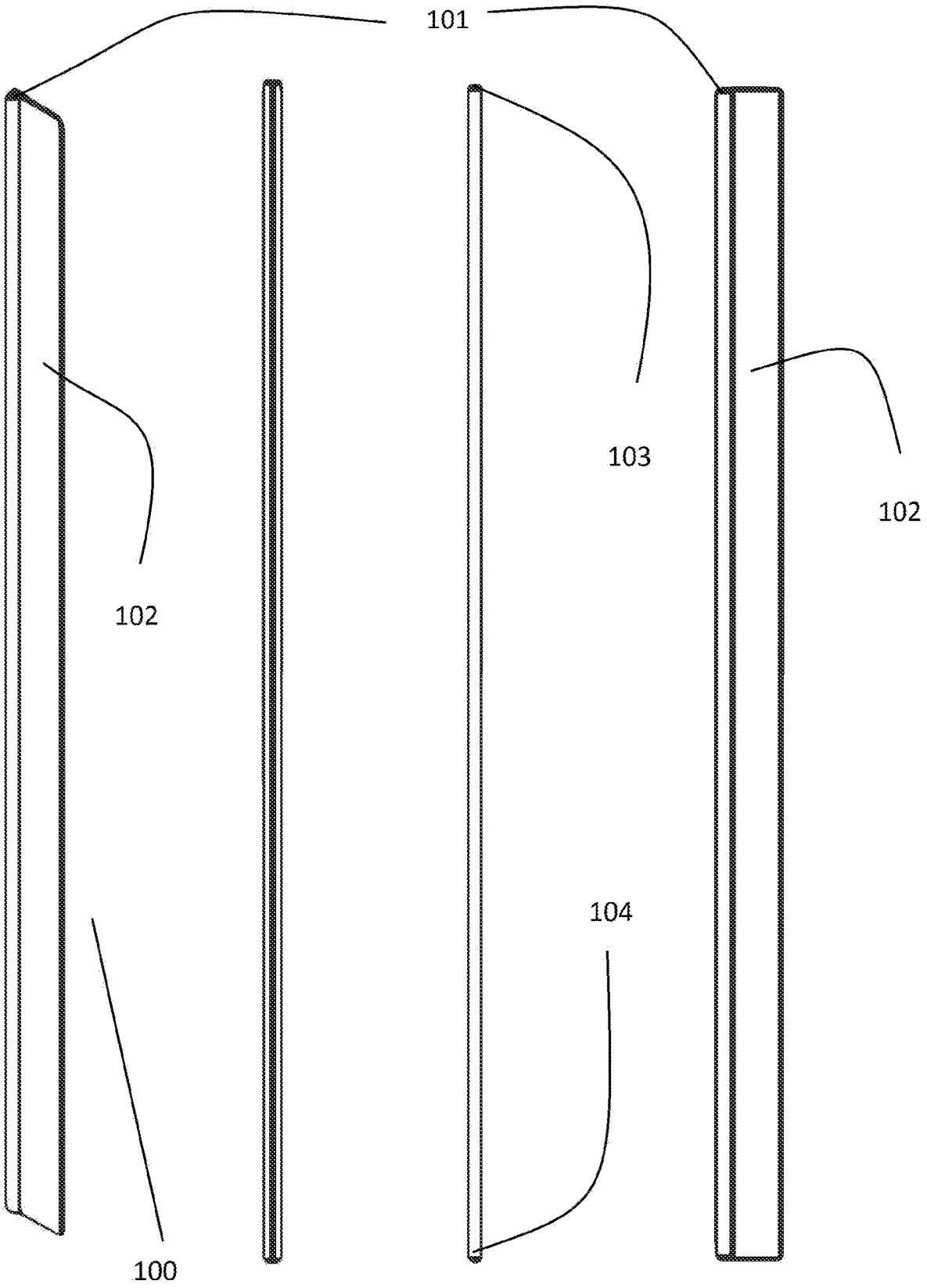
FIG. 1*a* is a perspective view of the modular rail-based storage system.
FIG. 1*b* is a top view of the modular rail-based storage system.
FIG. 1*c* is a bottom view of the modular rail-based storage system.
FIG. 1*d* is a front view of the modular rail-based storage system.

Without any intent to limit the scope of this invention, reference is made to the figures in describing the various embodiments of the invention. FIGS. 1 through 12 depict various aspects of exemplary embodiments of the present invention. Modular rail and attachment system 100 is shown having two main components, retainer rail 101 and attachment plate 102. Retainer rail 101 is an elongated, generally cylindrical member cast of a durable and flexible material with a substantially consistent profile along retainer rail's 101 entire length. It should be noted that a cylinder is a closed solid that has two parallel bases connected by a curved surface. While this shape is frequently circular, in keeping with its geometric definition, it is specifically defined herein as having any cross section, despite the Figs only presenting some variations of this, namely a circular variant. Variant cross sections would therefore be encompassed in such a cylindrical description, such as circular, oval, hexagonal, square and the like. Retainer rail 101 would, in an exemplary embodiment, have first opposite end 103 and second opposite end 104. Retainer rail 101 is generally shown throughout the Figs as having a circular cross section, but as noted above, it should be clear that various cross sections may be employed, such as a hexagonal, triangular, or any other advantageous geometric shape, and such cross sections would be encompassed in the claimed invention.

Attached to, and generally a component part of, retainer rail 101, is attachment plate 102. In some embodiments, attachment plate 102 is configured to generally run along substantially the entire length of retainer rail 101, meaning that the length of both will be substantially the same, but some variation in length may be advantageous in application and or execution, so small variations in the length of either should be considered part of the claimed invention. An exemplary embodiment, for example, may have a slightly longer dimension of one or the other of retainer rail 101 to add flexibility in mounting detachable attachments 201, or attachment plate 102 to add in stability to mounting surface/storage vessel 300. Further, in an exemplary embodiment, attachment plate 102 is cast as an integral part of retainer rail 101, meaning they are a single extruded, molded or cast piece, however, having these components cast separately would also be encompassed in the claimed invention.

Retainer rail 101 and attachment plate 102 are, in an exemplary embodiment, made from thermoplastic polyurethane (TPU) for various reasons. In addition to its properties of durability and flexibility, TPU provides a natural and highly effective form of friction between retainer rail 101 and the mating orifices 202 of detachable attachments 201, discussed infra. This material choice has been discovered in this application to have distinct structural and operational effects on the invention, namely, helping to prevent unwanted movement of detachable attachments 201 along retainer rail 101. This is due to TPU having slight amounts of deformity under pressure, which, when coupled with detachable attachments 201, proves to "dig in" or "bite" into the TPU to some small degree, helping to prevent unwanted sliding of detachable attachments 201.

Attachment plate 102 would also have to have a depth sufficient to permit the amounting of attachment plate 102 to mounting surface/storage vessel 300, which is going to be in proportion to the depth of retainer rail 101. This ratio would, in an exemplary embodiment, be a minimum of 4:1 to permit sufficient surface area of attachment plate 102 to be adhered, welded, sewn or otherwise attached to mounting surface/storage vessel 300. The mounting surface/storage vessel 300 can also have the attachment plate 102 affixed on any planar surface of mounting surface/storage vessel 300, such as the front, sides, back, interior, lid, etc., essentially any surface on the mounting surface/storage vessel 300.

Figure 8:
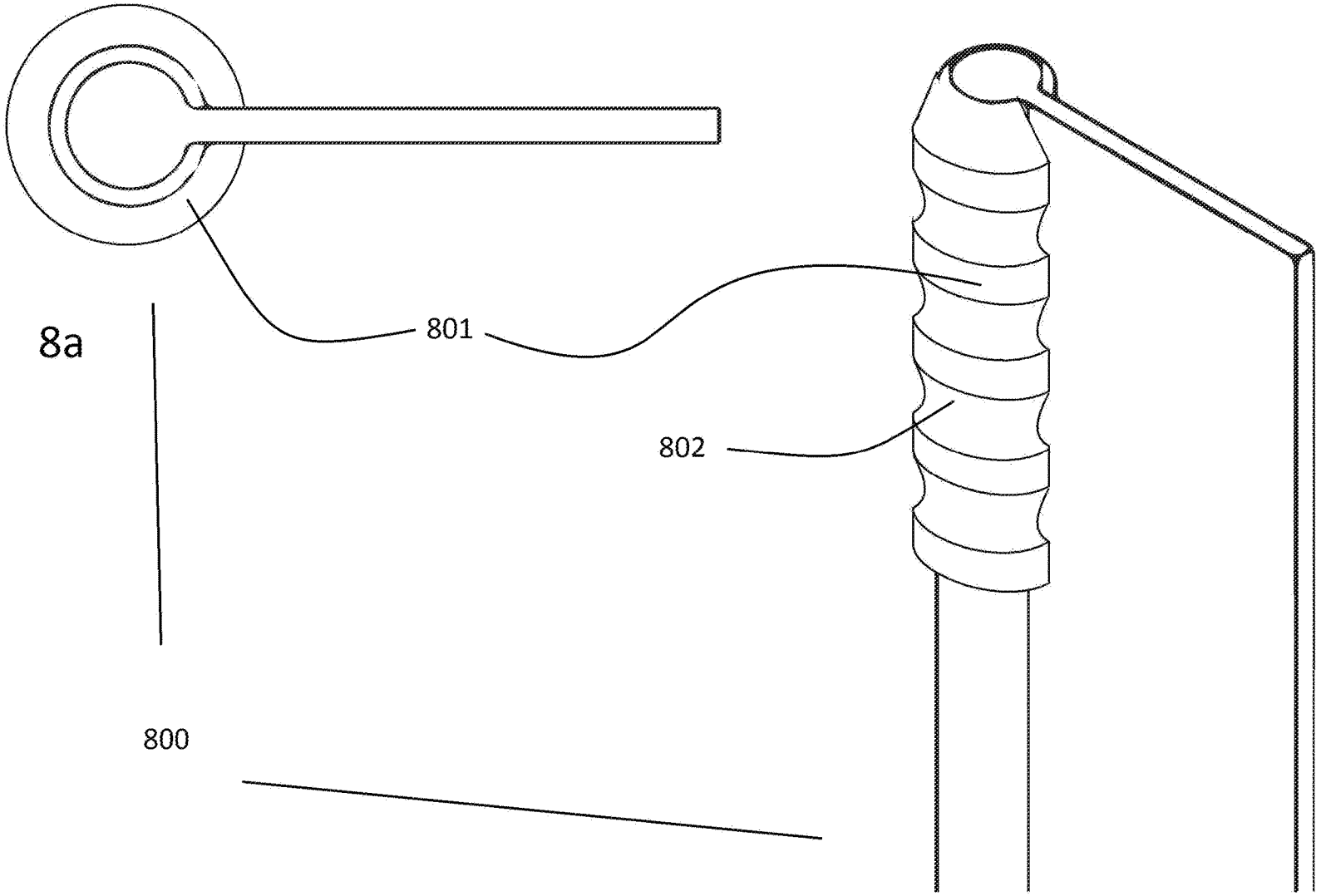
FIG. 8*a* is a side view of the modular rail-based storage system.
FIG. 8*b* is a perspective view of the modular rail-based storage system.

Alternatively, or in conjunction with these properties which help keep detachable attachments 201 positioned, retainer rail 101 can be shaped to have alternating ridges as seen in FIG. 8, (discussed in greater detail, supra) such that as a detachable attachment 201 is moved along the length of retainer rail 101, the diameter of retainer rail 101/801 varies, which makes the resultant contact with mating orifices 202 have alternating greater and lesser amounts of friction, and thus more ability to position detachable attachments 201 in a semi-fixed position.

Figure 2:
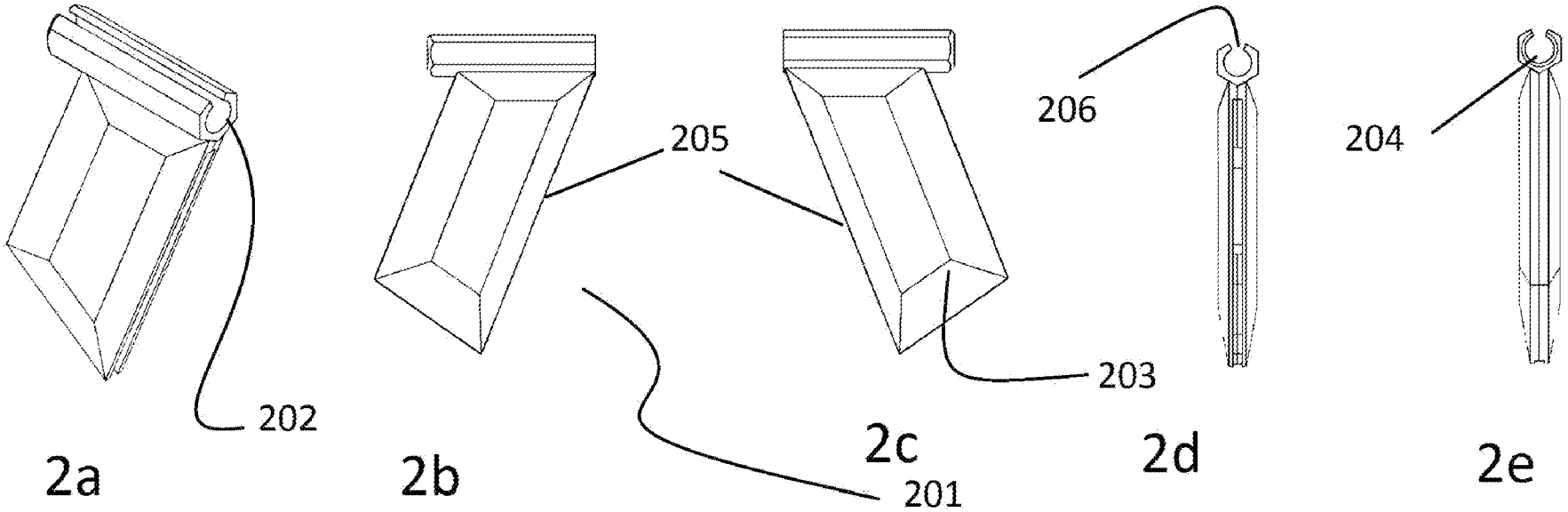
FIG. 2*a* is a perspective view of the detachable attachment.
FIG. 2*b* is a left view of the detachable attachment.
FIG. 2*c* is a right view of the detachable attachment.
FIG. 2*d* is a front view of the detachable attachment.
FIG. 2*e* is a rear view of the detachable attachment.

Retainer rail 101 and attachment plate 102 are thus designed to receive and attach to at least one detachable attachment 201 such as those seen in FIG. 2. These attachments 201 have a C-shaped mating orifice 202 operatively configured to frictionally engage retainer rail 101 by sliding mating orifice 202 over retainer rail 101, and wherein attachment plate 102 passes through the open portion 206 of the C-shaped orifice 202, with mating orifice 202 enveloping substantially all of the circumference of retainer rail 101. It is specifically noted here that "C-shaped" is not meant to be limiting to a conventional circular "C" shape, but any shape that has the majority of its perimeter closed, aside from an open portion 206 that will permit the slidable interaction such as that seen in the Figs between retainer rail 101/attachment rail 102 and detachable attachment 201 mating orifice 202. In most instances, less than the full length of retainer rail 101 would be engaged by a single detachable attachment 201, however, the use of entire retainer rail 101 would not be precluded or excluded from the bounds of the claimed invention.

The engagement of less than the full length of retainer rail 101 is a significant point, since in an exemplary embodiment, having a length of TPU retainer rail 101 on either side of detachable attachment 201 helps to keep detachable attachment stationary, since the edges of mating orifice 202 tend to lodge or "bite" into the TPU material on either side of mating orifice 202, aiding in the transient positioning of detachable attachment 201, as discussed supra.

In an exemplary embodiment, storage vessel 300 would also be employed, upon which at least one said attachment plate 102 is affixed to, and further wherein at least one of first opposite end 103 or second opposite end 104 of said retainer rail 101/301 is not attached to storage vessel 300, thus leaving at least one end of retainer rail 101/301 exposed and accessible as seen in the Figs. This allows the open end of retainer rail 101/301 to be utilized to slide on mating orifice 202 of detachable attachment 201.

Other features can be employed as well, such as placing caps at the terminal ends of first opposite end 103 or second opposite end 104 of retaining rail 101 to prevent the escape of the attached detachable attachments 201. Covering retainer rail 101 with fabric may also be employed to increase the friction coefficient and/or dampen the motion and movement of detachable attachments 201 along retainer rail 101.

Conversely, or in conjunction with, the terminal ends of first opposite end 103 and/or second opposite end 104 can be conically-shaped at their ends in order to facilitate the placing of detachable attachments 201 onto retainer rail 101. Similarly, the corresponding ends of detachable attachments 201 can have chamfered mating orifices 202 employed to ease the transition onto retainer rail 101.

A storage vessel 300 is but one example of what the system 100 can be used with. Modular rail and attachment system 100 can also simply be attached to a flat plate, or mounting surface. An example of such a flat surface is storage vessel 300, but could just as easily be a wall, boat hull, cooler, or any suitably-sized substantially-planar surface.

Figure 3:
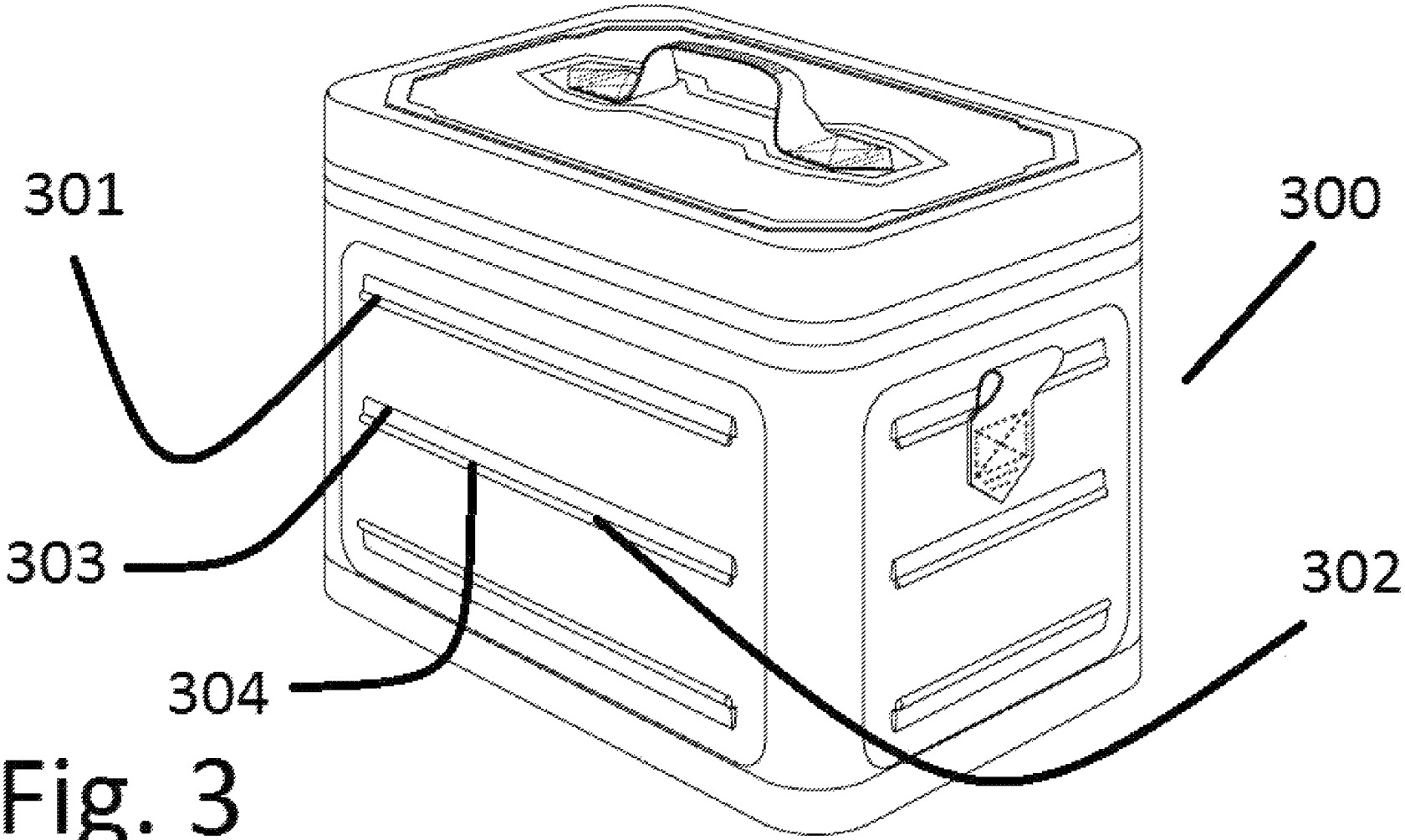
FIG. 3 is a perspective view of the storage vessel.

In another exemplary embodiment, attachment and retainer system 100 can be employed with more than one system 100 to create sets of modular storage attachment points. In one example, as is seen in FIG. 3, multiple systems 301 can be affixed to storage vessel 300. In the exemplary embodiment, secondary retainer rail 303 is configured with a secondary attachment plate 304 in the same way as retainer rail 101 and attachment plate 102 are, and the secondary retainer system 302 is affixed parallel to retainer rail 101 and attachment plate 102 to permit even more flexible and modular storage options. Using the dual channel detachable attachment seen in FIG. 10, first c-shaped mating orifice 1001 can be attached to one system 301, while second c-shaped mating orifice 1002 is attached to an adjacent, parallel, system 302.

In any configuration, detachable attachments 201 are designed to have multiple uses, but generally will have at least three edges 205, forming functional plate 203. Upon at least one of at least three edges 205 is found the mating orifice 202 that attaches to rail system 100. Other edges 205 can contain a wide variety of variable components, or additional mating orifices 202, if desired for flexibility.

Figure 4:
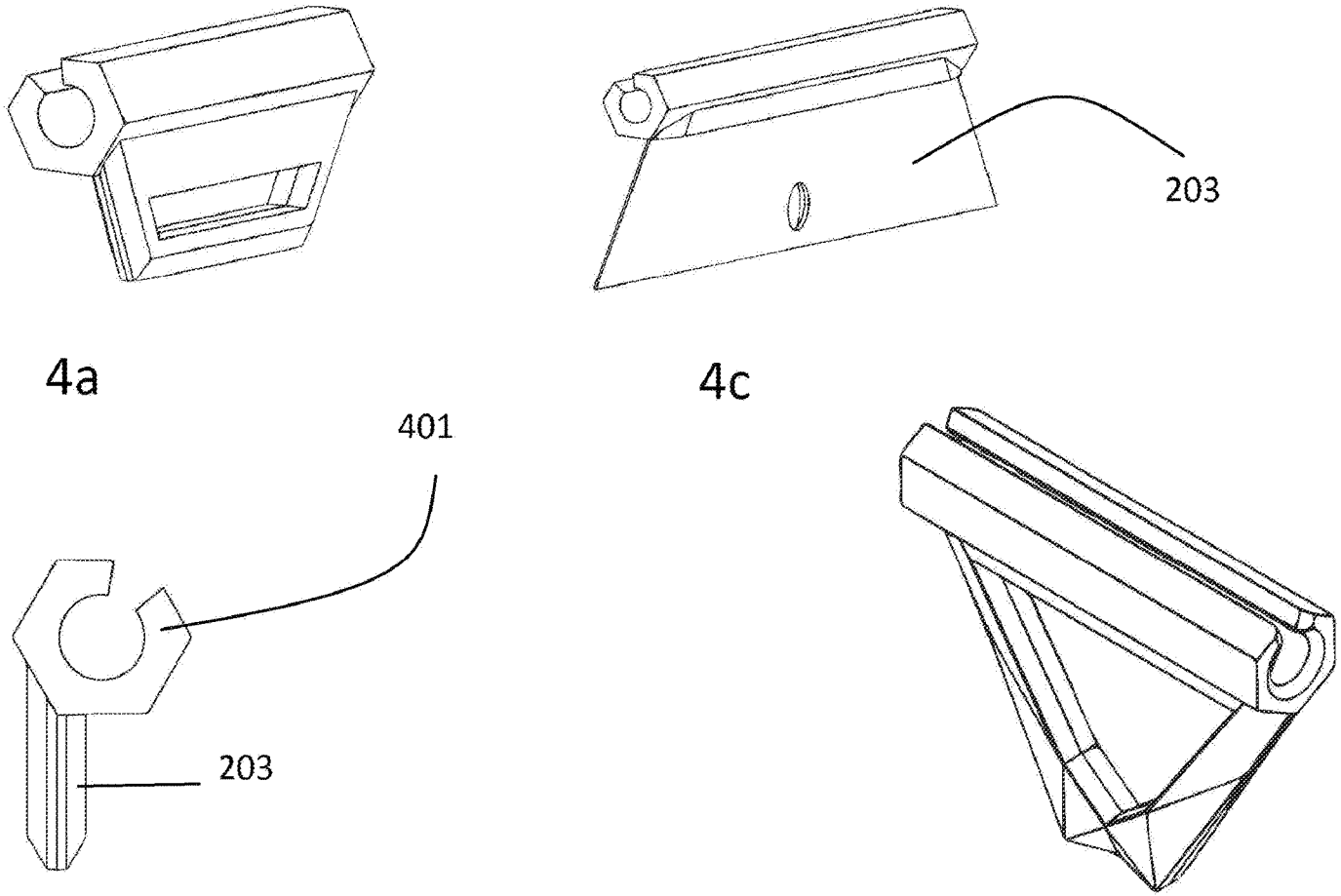
FIG. 4*a* is a perspective view of a detachable attachment.
FIG. 4*b* is a side view of a detachable attachment.
FIG. 4*c* is a perspective view of a detachable attachment.
FIG. 4*d* is a side view of a detachable attachment.
FIG. 4*e* is a perspective view of a detachable attachment.

In some cases, detachable attachments 201 may have a variation in assembly whereby mating orifice 202 is not centered relative to attachment plate 102. FIG. 4 shows such an example, wherein mating orifice 401 of detachable attachment 400 is off centered, or rotated about the typical center-style attachment point of FIG. 2. This permits a wider variety of components to be utilized on detachable attachments 201/400, since it allows a varying angle of the mounted item(s) relative to the storage vessel 300 or mounting plate.

Figure 5:
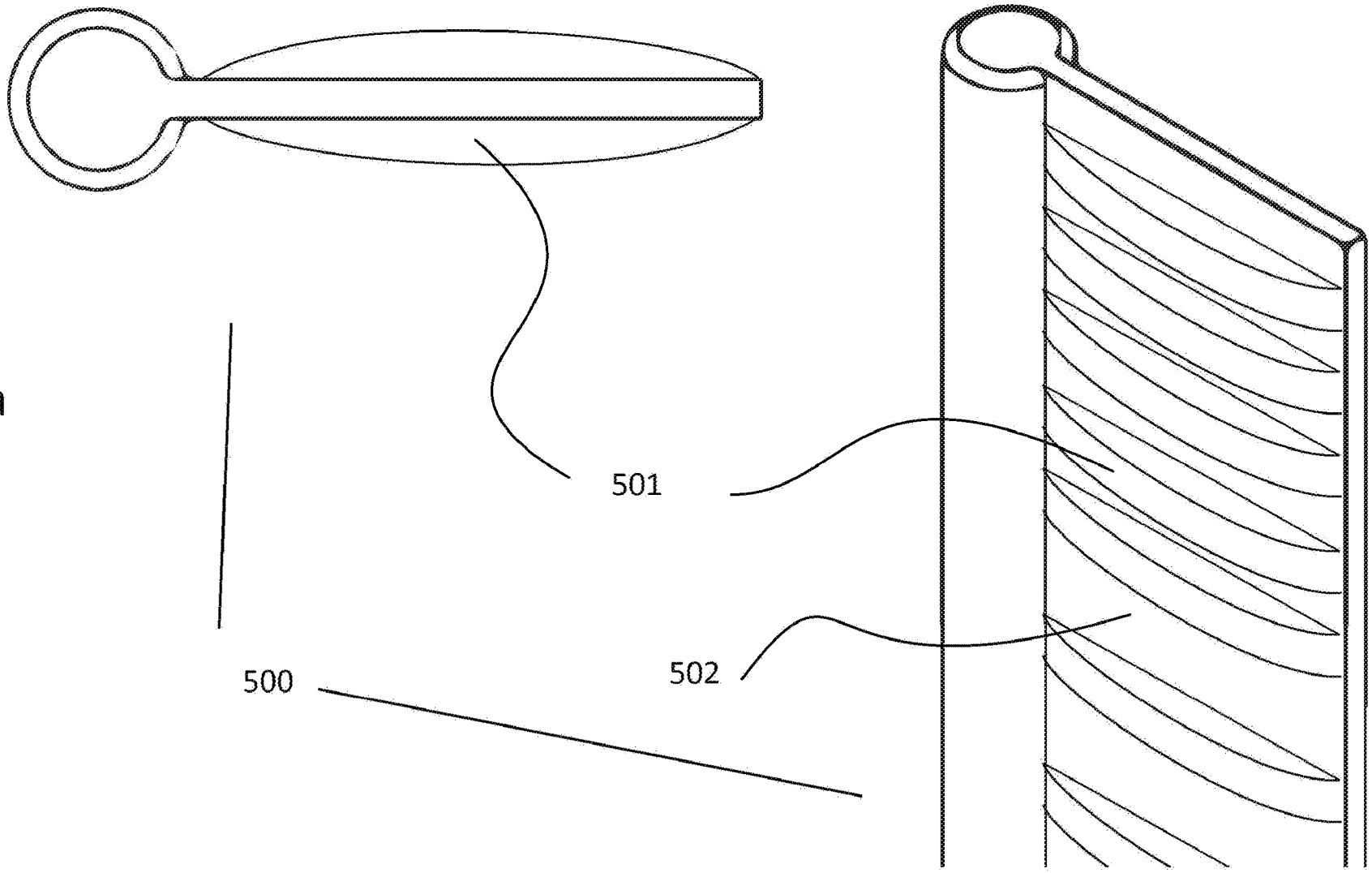
FIG. 5*a* is a side view of the modular rail-based storage system.
FIG. 5*b* is a perspective view of the modular rail-based storage system.
Figure 6:
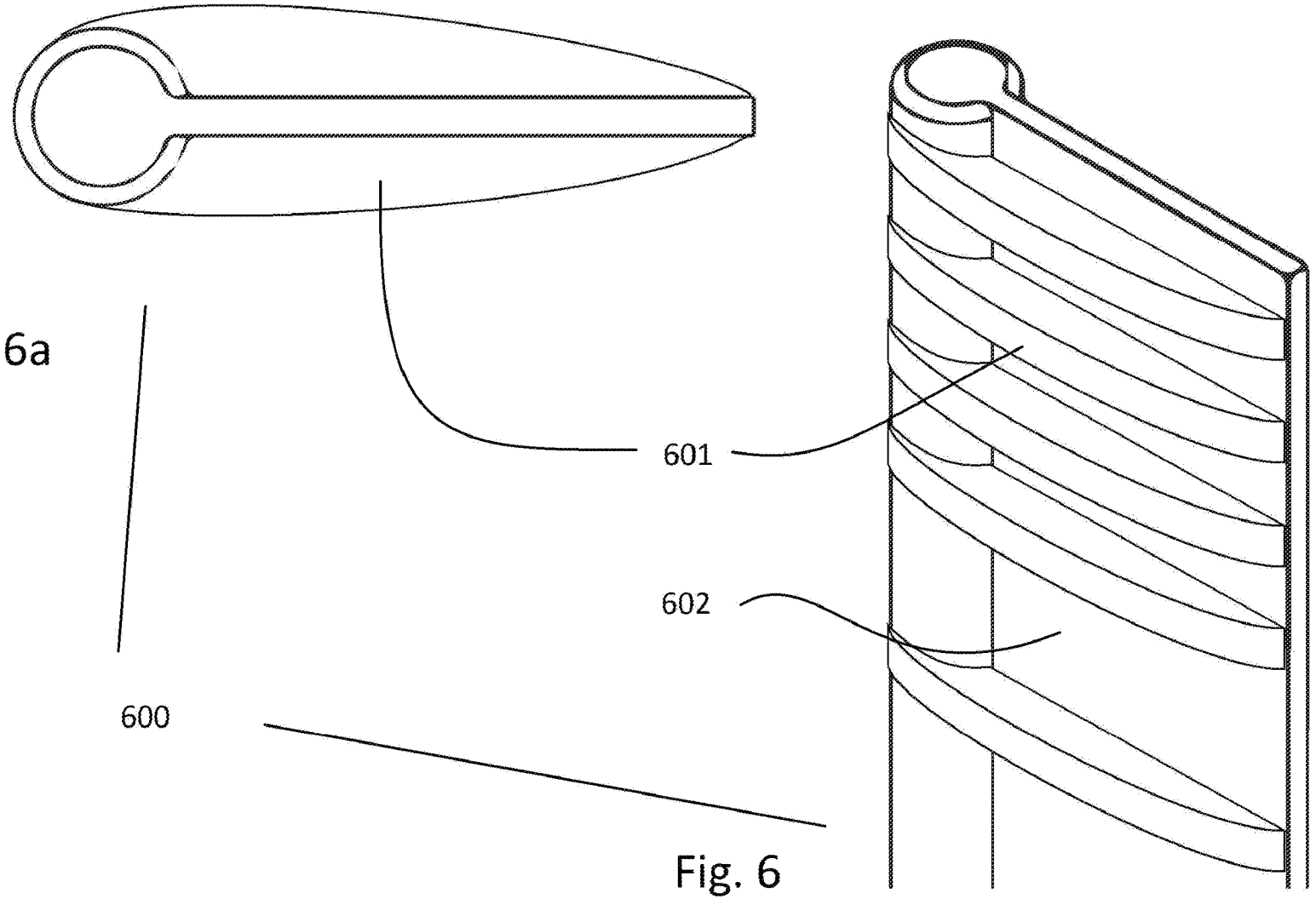
FIG. 6*a* is a side view of the modular rail-based storage system.
FIG. 6*b* is a perspective view of the modular rail-based storage system.
Figure 7:
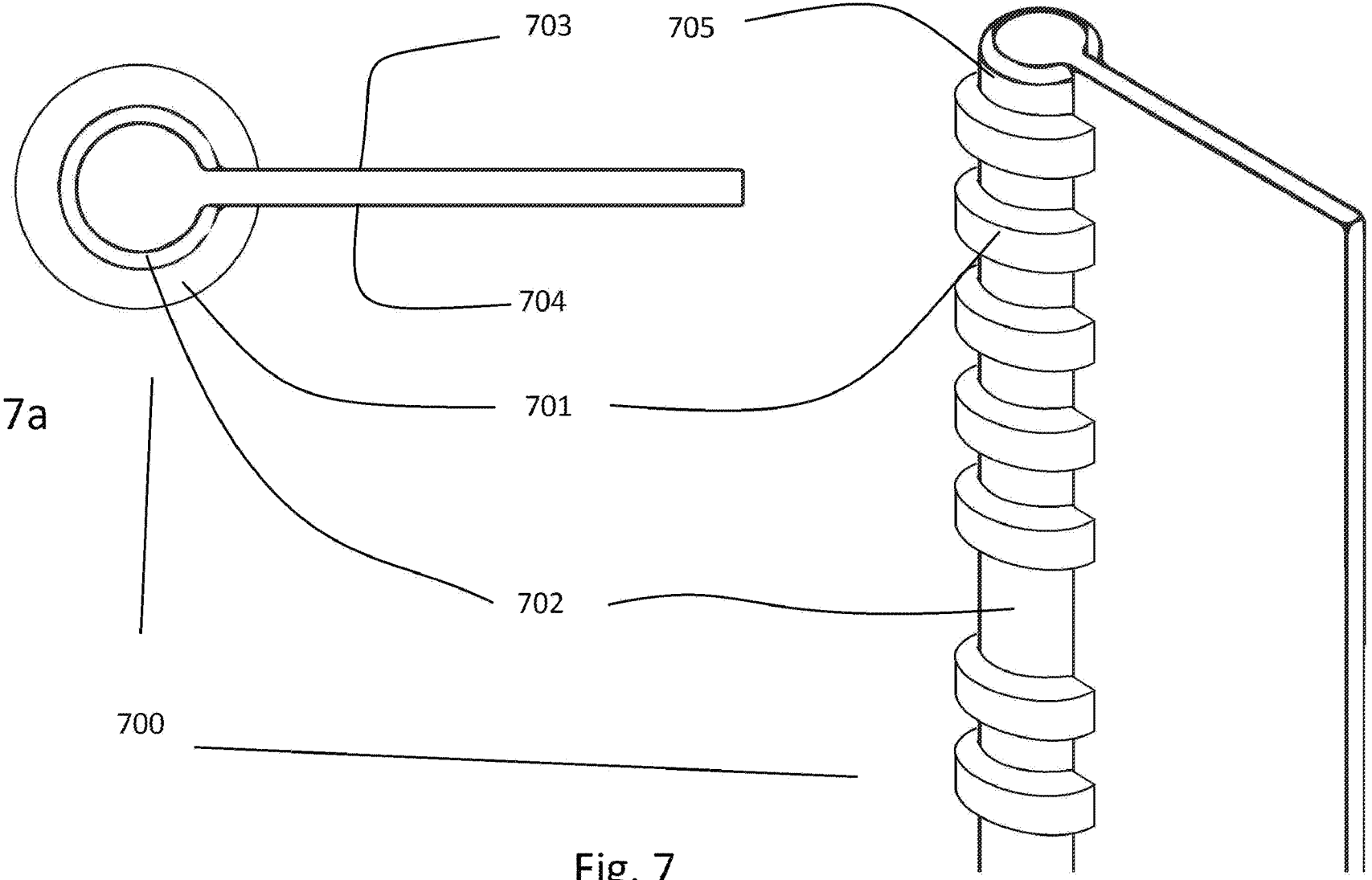
FIG. 7*a* is a side view of the modular rail-based storage system.
FIG. 7*b* is a perspective view of the modular rail-based storage system.

Variations on retainer rail 101 and attachment plate 102 are also presented as part of the invention, wherein relief points, such as ridges and valleys, can be cast in either retainer rail 101 and/or first face 703 or second face 704 of attachment plate 102 to create different attachment modes. Examples of these can be found in FIGS. 5-8, wherein FIG. 5 shows such ridges 501 and valleys 502 in attachment plate 102. FIG. 7 shows similar ridges 701 and valleys 702 in circumferential surface 705 of retainer rail 101, and FIG. 6 shows these ridges 601 and valleys 602 in both attachment plate 102 and circumferential surface 705 of retainer rail 101. FIG. 8 shows a varied type of ridges 801 and valleys 802 in a "bamboo" type design 800. This design has alternating diameters of retainer rail 101 such that the diameters alternate from larger to smaller (thus having multiple diameters) via these ridges 801 and valleys 802.

Figure 9:
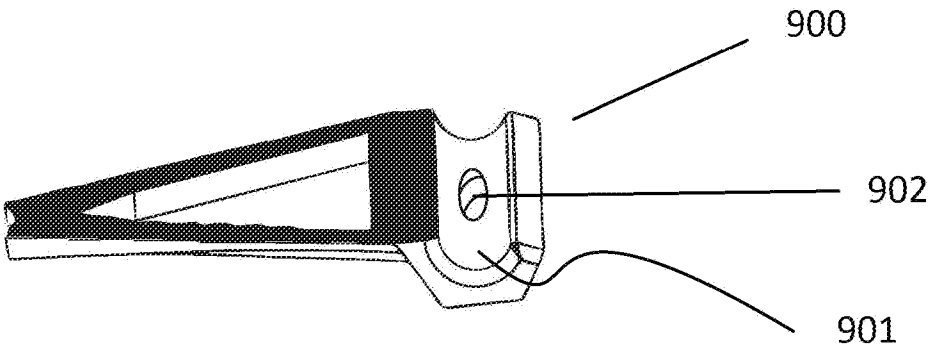
FIG. 9 is a perspective view of a detachable attachment.
Figure 10:
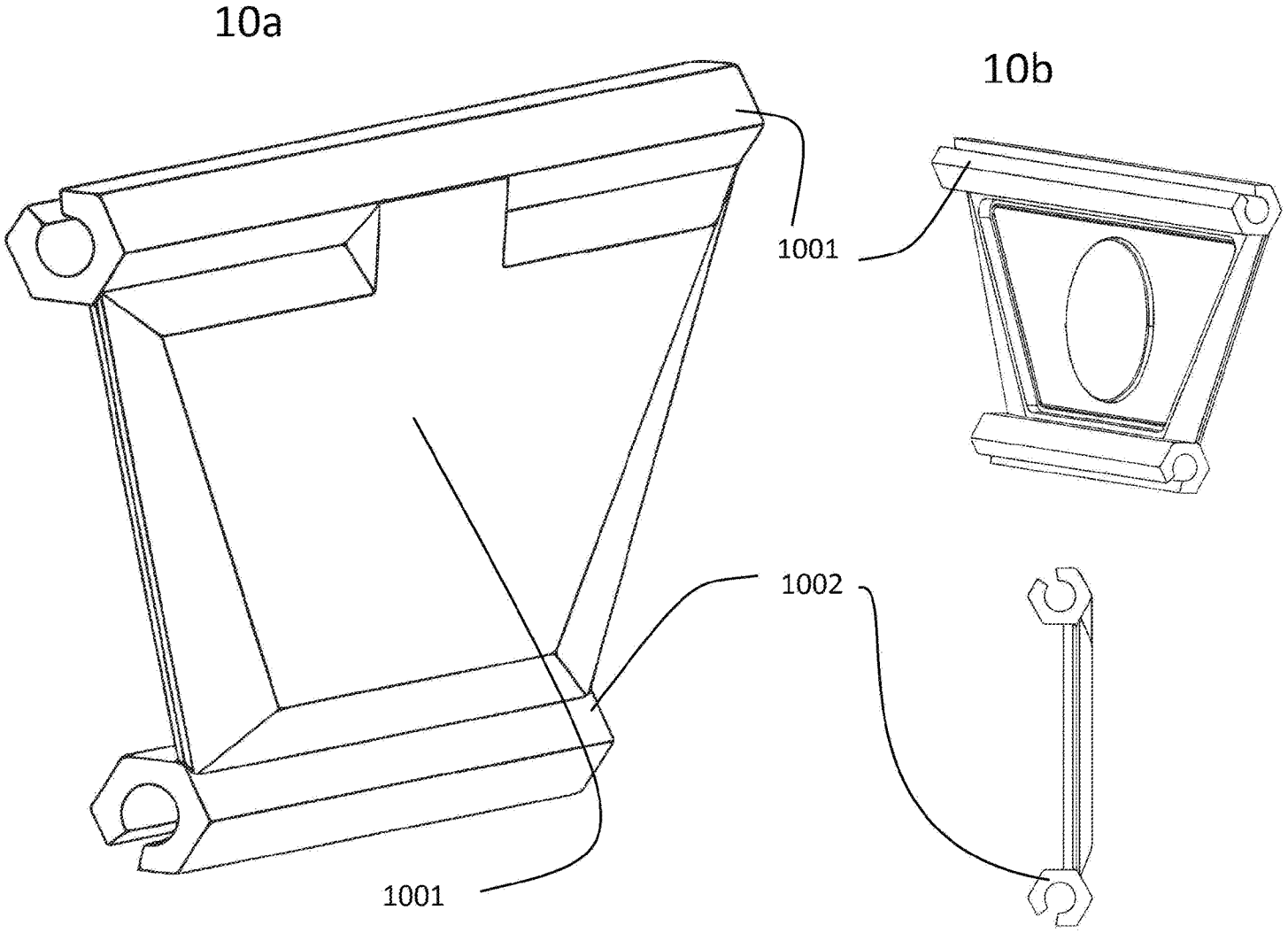
FIG. 10*a* is a perspective view of a detachable attachment.
FIG. 10*b* is a perspective view of a detachable attachment.
FIG. 10*c* is a perspective view of a detachable attachment.
Figure 11:
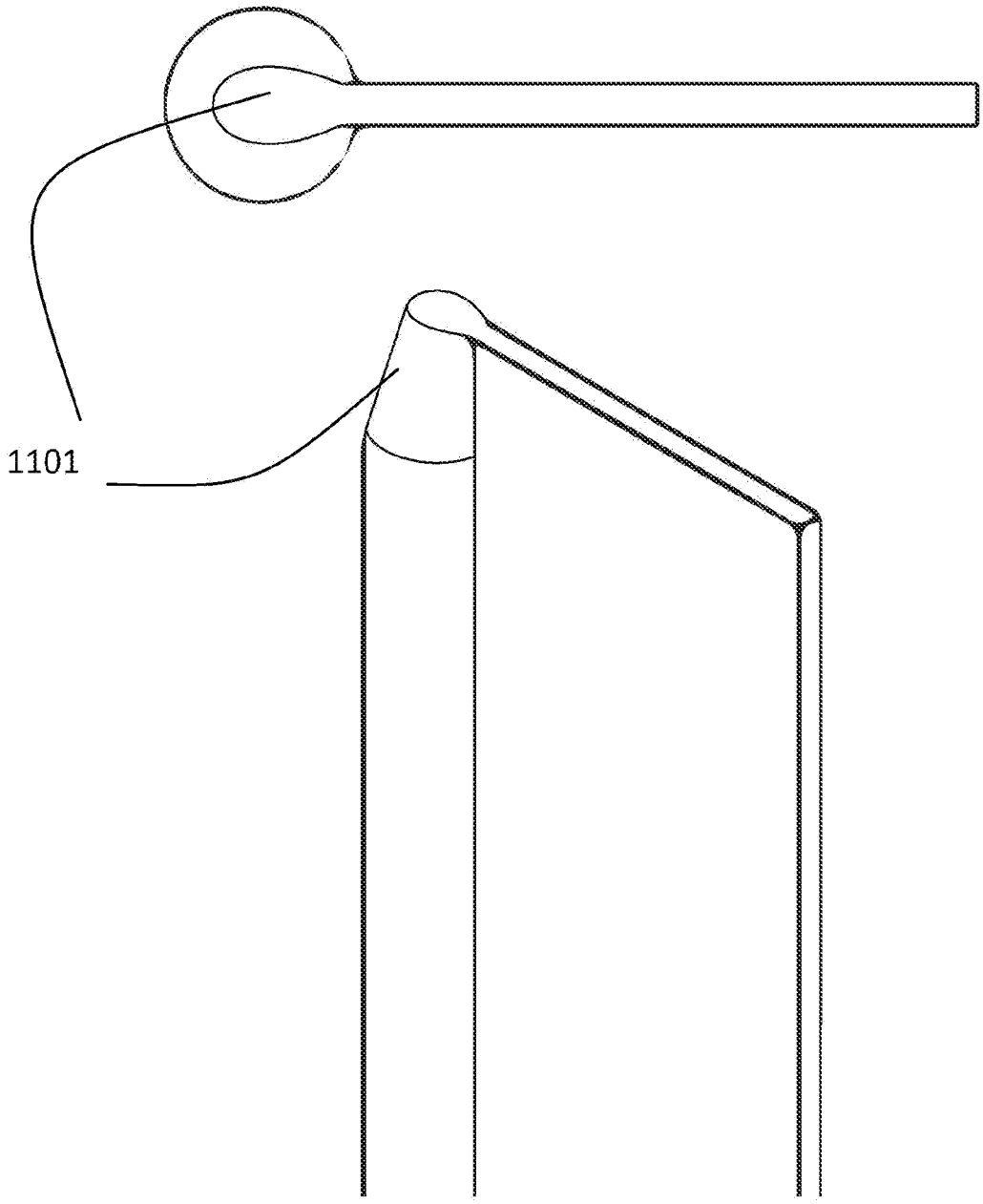
FIG. 11*a* is a side view of a conical end of a retainer rail.
FIG. 11*b* is a perspective view of a conical end of a retainer rail.

The above variations can also be coupled with another modification to detachable attachment 201. Such an example is seen in FIG. 9, wherein detachable attachment 900 has catch 902, or protrusion, that interacts with the ridges and valleys, to "lock" or otherwise limit travel of detachable attachment 201 along retainer rail 101.

Figure 12:
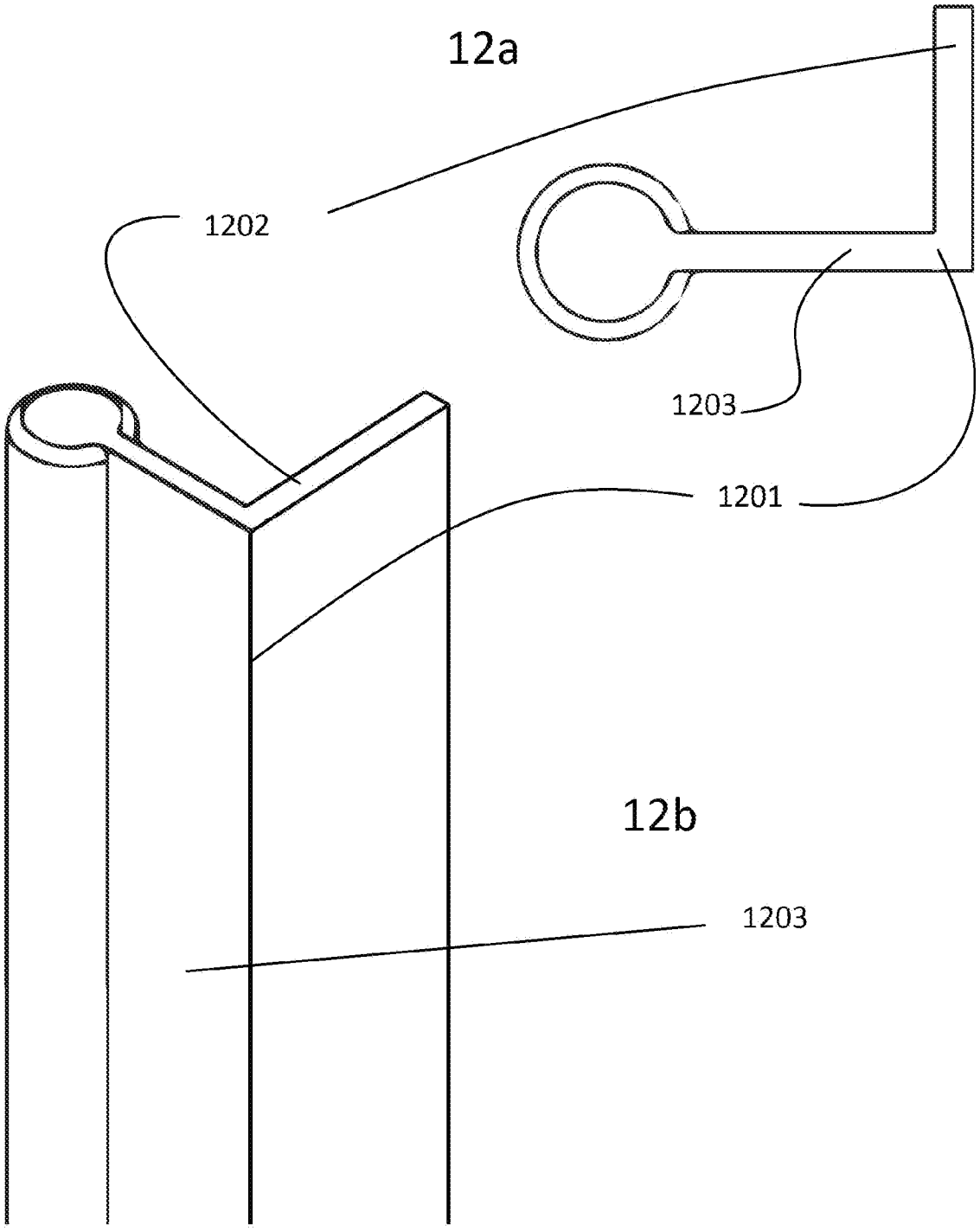
FIG. 12*a* is a side view of an angled attachment plate.
FIG. 12*b* is a perspective view of an angled attachment plate.

It should also be noted that a variation may also include a version of the invention as seen in FIG. 12 wherein said attachment plate 102 has first plane 1202 and a second plane 1203, and further wherein first plane 1202 is oriented at an angle relative to second plane 1203. This angle can be any angle that is desired to make storage more flexible, and in the exemplary embodiment in the Figs., the angle is approximately 45 degrees, thus creating an approximately "L"-shaped attachment plate 102. This angled relationship would offer varied flexibility in what can be stored in conjunction therewith by offsetting the angle of the retainer rail 101 relative to the mounting surface/storage vessel 300. This angular relationship can be in any angle desired, and any angle should be considered within the scope of this invention.

In operation, then, this apparatus very efficiently permits a user to slide on and off a fully variable number and type of detachable attachments 201 via their mating orifice 202 onto retaining rail 101 of mounting surface/storage vessel 300 for easy transport of a multitude of items via a single storage device.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined herein.

The invention claimed is:

1. A modular rail and attachment system comprising:

a. a retainer rail comprising an elongated cylindrical member cast of a durable and flexible material having a substantially consistent profile along said cylindrical member's entire length and having a first opposite end and a second opposite end;

b. said retainer rail further comprising an attachment plate configured to be attached along substantially the entire length of said retainer rail and wherein said attachment plate is cast as an integral part of said retainer rail;

c. at least one detachable attachment forming a C-shaped mating orifice operatively configured to frictionally engage said retainer rail; and d. a storage vessel upon which at least one said attachment plate is affixed to, and further wherein at least one of said first opposite end or said second opposite end of said retainer rail is not attached to said storage vessel.

2. The attachment and retainer system of claim 1 wherein said retainer rail and said attachment plate are made from thermoplastic polyurethane.

3. The attachment and retainer system of claim 1 wherein said retainer rail has a circular cross section.

4. The attachment and retainer system of claim 1 wherein said retainer rail has a hexagonal cross section.

5. The attachment and retainer system of claim 1 wherein said retainer rail has a cross section having variable diameters along said retainer rail.

6. The attachment and retainer system of claim 1 further comprising:

a. a secondary retainer rail having a secondary elongated cylindrical member comprised of a durable and flexible material having a substantially consistent profile along said secondary cylindrical member and having a secondary first opposite end and a secondary second opposite end;

b. a secondary attachment plate configured to be attached along substantially the entire length of said secondary retainer rail and wherein said secondary attachment plate is cast as an integral part of said secondary retainer rail; and c. wherein said secondary attachment plate is affixed to said storage vessel in an orientation substantially parallel to said retainer rail.

7. The attachment and retainer system of claim 6 wherein said detachable attachment further comprises a secondary C-shaped mating orifice which is operatively configured to frictionally engage said secondary retainer rail.

8. The attachment and retainer system of claim 1 wherein said detachable attachment further comprises a functional plate having at least three edges which is mounted along said at least one edge of said mating orifice.

9. The attachment and retainer system of claim 8 wherein said functional plate is mounted in an angled orientation having a measurement other than 180 degrees to said mating orifice.

10. The modular rail and attachment system of claim 1, further comprising a cap on at least one of said first opposite end or said second opposite end.

11. The modular rail and attachment system of claim 1, wherein at least one of said first opposite end or said second opposite end is conically-shaped.

12. The modular rail and attachment system of claim 1, wherein said retainer rail further comprises a fabric covering along substantially said entire retainer rail.

13. The attachment and retainer system of claim 1 wherein said mating orifice is chamfered.

14. The attachment and retainer system of claim 1 wherein said attachment plate further comprises a first face and a second face, and wherein at least one of said first face or said second face further comprises relief points cast into at least one of said first face or said second face.

15. The attachment and retainer system of claim 14 wherein said retainer rail further comprises circumferential surface, and wherein said circumferential surface further comprises relief points cast into said circumferential surface.

16. The attachment and retainer system of claim 1 wherein said retainer rail further comprises a circumferential surface, and wherein said circumferential surface further comprises relief points cast into said circumferential surface.

17. The attachment and retainer system of claim 1 wherein said attachment plate has a first plane and a second plane, and further wherein said first plane is oriented at an angle that is not 180 degrees relative to said second plane.

18. The attachment and retainer system of claim 1 wherein said detachable attachment has a catch integrated within said mating orifice operatively configured to engage said retainer rail.

19. The attachment and retainer system of claim 1 wherein said detachable attachment is operatively configured to frictionally engage less than the full length of said cylindrical member.

20. The method of using the apparatus in claim 1 to connect said detachable attachment to said retainer rail.

21. A modular rail and attachment system comprising:

a. a retainer rail comprising an elongated cylindrical member cast of a durable and flexible material having a substantially consistent profile along said cylindrical member's entire length and having a first opposite end and a second opposite end;

b. said retainer rail further comprising an attachment plate configured to be attached along substantially the entire length of said retainer rail and wherein said attachment plate is cast as an integral part of said retainer rail;

c. at least one detachable attachment forming a C-shaped mating orifice operatively configured to frictionally engage said retainer rail; and d. a mounting plate upon which at least one said attachment plate is affixed to, and further wherein at least one of said first opposite end or said second opposite end of said retainer rail is not attached to said mounting plate.

22. A modular rail and attachment system comprising:

a. at least one retainer rail comprising an elongated cylindrical member cast of a durable and flexible material having a substantially consistent profile along said cylindrical member's entire length and having a first opposite end and a second opposite end;

b. said at least one retainer rail further comprising an attachment plate configured along substantially the entire length of said cylindrical member and wherein said attachment plate is cast as an integral part of said at least one retainer rail; and c. a storage vessel upon which at least one said attachment plate is affixed to, and further wherein at least one of said first opposite end or said second opposite end of said at least one retainer rail is not attached to said storage vessel.

23. A modular rail and attachment system comprising:

a. at least one retainer rail comprising an elongated cylindrical member cast of a durable and flexible material having a substantially consistent profile along said cylindrical member's entire length and having a first opposite end and a second opposite end;

b. at least one said retainer rail further comprising an attachment plate configured along substantially the entire length of said retainer rail and wherein said attachment plate is cast as an integral part of said at least one retainer rail; and c. a mounting plate upon which at least one said attachment plate is affixed to, and further wherein at least one of said first opposite end or said second opposite end of said at least one retainer rail is not attached to said mounting plate.

* * * * *